US005730245A

United States Patent [19]

Conway

[11] Patent Number: 5,730,245

[45] Date of Patent: Mar. 24, 1998

[54] SAFETY CABLE DECK ANCHOR

[76] Inventor: John Conway, 946 Harford-Slaterville Rd., Dryden, N.Y. 13053

[21] Appl. No.: 626,466

[22] Filed: Apr. 2, 1996

[51] Int. Cl.[6] ..... A62B 35/02

[52] U.S. Cl. ..... 182/3; 182/45

[58] Field of Search ..... 182/3, 45; 248/228.5, 248/228.1, 231.61

[56] References Cited

U.S. PATENT DOCUMENTS

| | | | |
|---|---|---|---|
| 1,137,598 | 4/1915 | Flentje | 248/228.5 |
| 4,856,616 | 8/1989 | Anderson | 248/228.5 |
| 5,137,249 | 8/1992 | Royster | 248/231.61 |
| 5,320,193 | 6/1994 | Bongiovanni | 182/3 |
| 5,346,036 | 9/1994 | Arisman | 182/3 |
| 5,560,576 | 10/1996 | Cargill | 248/228.51 |
| 5,564,726 | 10/1996 | Hearn | 248/231.61 |

*Primary Examiner*—Alvin C. Chin-Shue
*Attorney, Agent, or Firm*—Brown, Pinnisi & Michaels, P.C.

[57] ABSTRACT

The invention presents an easy to use anchor for safety cables which can be attached to the framing of the floor as it is built, and removed and re-used after the floor is completed. The anchor has lower and upper plates separated by a spacer the thickness of an I-beam cross-plate. The anchor clamps between two adjacent beams, with the upper and lower plates sliding around the top plate of the I-beam and being fastened firmly with setscrews in the lower plate. Eye bolts screw into the anchor plate to provide a tie-off spot for cables. The thickness of the anchor plate over the deck support beams is such that the top of the anchor plate is flush with the surface of the plywood decking over which the concrete will be poured. In use, the anchor is slid into the desired location between the top plates of two deck support I-beams and screwed tightly into place using the setscrews in the lower plate of the anchor. When the plywood deck is laid, it is notched around the anchor plate, and the surface of the upper plate of the anchor forms a flush floor with the top of the plywood deck. The workers can tie off their safety cables to the eyebolts screwed into the anchor. When the time comes to pour the floor, the eyebolts are removed and the holes covered with duct tape. The floor is poured, and when it cures and the beams and plywood are removed, the anchors can be easily detached from the I-beams and re-used.

6 Claims, 1 Drawing Sheet

SAFETY CABLE DECK ANCHOR

FIELD OF THE INVENTION

The invention pertains to the field of safety devices. More particularly, the invention pertains to devices used to anchor safety lines for construction workers.

BACKGROUND OF THE INVENTION

With the advent of the Occupational Safety and Health Administration (OSHA), it has become necessary for employers to comply with new regulations regarding the safety of employees. In the construction industry, these regulations have recently been amended to require safety ropes or cables to secure workers working on the framework of buildings under construction.

Buildings using poured concrete construction pose particular problems in compliance with this requirement. In such buildings, each floor is built by constructing a framework of vertical posts, jacks or columns and horizontal I-beams on the lower floor, laying a plywood flooring on top of the I-beams, putting reinforcing bars or grid on top of the plywood, and then pouring concrete on top of the plywood forming the reinforced concrete floor. When the floor has cured, the columns, beams and plywood are removed and the next set of columns, beams and plywood is used to build the next floor. OSHA requires that construction workers laying the plywood, pouring the concrete, raising the beams, and so on, be tied off with safety cables, against the danger of falling.

With such a construction method, it is difficult to find a place to attach the required cables. There is often no overhead beams to which one can tie, and sometimes it becomes necessary to erect a network of overhead cables or floor cables solely to provide an anchor point for the workers' safety cables. The tangle of safety cables on the floor can become a hazard in themselves, and a nuisance at the best of times.

SUMMARY OF THE INVENTION

The invention presents an easy to use anchor for safety cables which can be attached to the framing of the floor as it is built, and removed and re-used after the floor is completed. The anchor has lower and upper plates separated by a spacer the thickness of an I-beam cross-plate. The anchor clamps between two adjacent beams, with the upper and lower plates sliding around the top plate of the I-beam and being fastened firmly with setscrews in the lower plate. Eye bolts screw into the anchor plate to provide a tie-off spot for cables. The thickness of the anchor plate over the deck support beams is preferably such that the top of the anchor plate is flush with the surface of the plywood decking over which the concrete will be poured.

In use, the anchor is slid into the desired location between the top plates of two deck support I-beams and screwed tightly into place using the setscrews in the lower plate of the anchor. When the plywood deck is laid, it is notched around the anchor plate, and the surface of the upper plate of the anchor forms a flush floor with the top of the plywood deck. The workers can tie off their safety cables to the eyebolts screwed into the anchor. When the time comes to pour the floor, the eyebolts are removed and the holes covered with duct tape. The floor is poured, and when it cures and the beams and plywood are removed, the anchors can be easily detached from the I-beams and re-used.

DESCRIPTION OF THE PREFERRED EMBODIMENT

Figure 1:
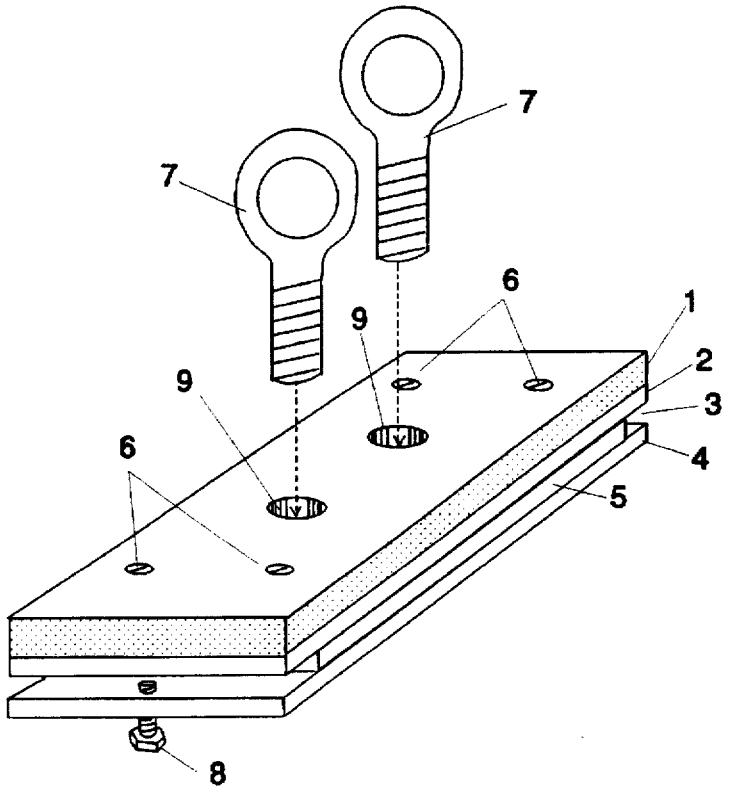
FIG. 1 shows a perspective view of the anchor of the invention.

As can be seen, the body of the invention is basically rectangular, with a length sufficient to span two I-beams in the supporting structure for a floor. The invention slips over and, preferably, clamps to the upper flanges of two adjacent I-beams. The construction of the preferred embodiment of the invention can be seen in FIG. 1 and cut-away FIG. 2.

The body of the invention has three main layers: the upper (2) and lower plates (4), which are preferably steel or some other metal for strength, and spacer layer (5), between the upper (2) and lower (4) plates. The spacer layer is preferably of steel and is of approximately the same thickness as the flange (14) or slightly thicker (⅜" steel is preferred). The spacer layer is slightly shorter than the inter-I-beam spacing, to create an end gap (3) between the upper (2) and lower (4) plates. Preferably, the three main layers are welded together for strength and safety. Alternatively, they could be fastened together with bolts or recessed screws, or connected adhesively.

In practice, the length of the anchor and the spacer layer will depend on the inter-beam spacing chosen by the engineer. Typically, the spacer layer will be 12" to 16" long, with the upper (2) and lower (4) plates and the face layer (1) described below being approximately 1" to 1½" longer, creating a gap of approximately ½" to ¾" in depth Setscrews (8) threaded into mating holes near the ends of the lower plate (4) extend into the gap (3), and can be screwed in to compress against the upper flange (14) of an I-beam (11) to hold the anchor of the invention rigidly in place.

The preferred embodiment of the invention has a face layer (1) which is preferably of plywood, particle board, or the like. The face layer (1) is preferably fastened down to the upper plate (2) by flush screws (6) in countersunk holes in the face layer, threaded into the upper plate (2), as shown. Alternatively, the face layer could be adhesively attached to the top plate, or recessed wood or self-tapping screws could be run up into the face layer from below.

The thickness of the face layer (1) and upper plate (2) are chosen so that the two layers, together, total the same as the thickness of the plywood decking (10) which is being used on the floor being built. In most cases, the use of ¼" steel for the upper plate (2) and ½" plywood or particle board for the top layer (1) will properly match the ¾" plywood most often used for decking.

As an alternative, the face layer (1) could be omitted, although this is not preferred. In such a case, the plywood decking could be marked from underneath and drilled for the anchor holes. The outline of the anchor plate could be routed out in the underside of the plywood deck. This method would preserve the flush nature of the plywood deck, leaving only small holes in the surface to be plugged or taped before pouring concrete. If desired, the plywood could still be notched around the anchor plate, which would leave a rectangular lump underneath the final concrete floor, the depth of the missing face layer. Although this is not ideal, in most cases the periodic lumps would not matter as a dropped ceiling will be installed to hide such imperfections.

Figure 2:
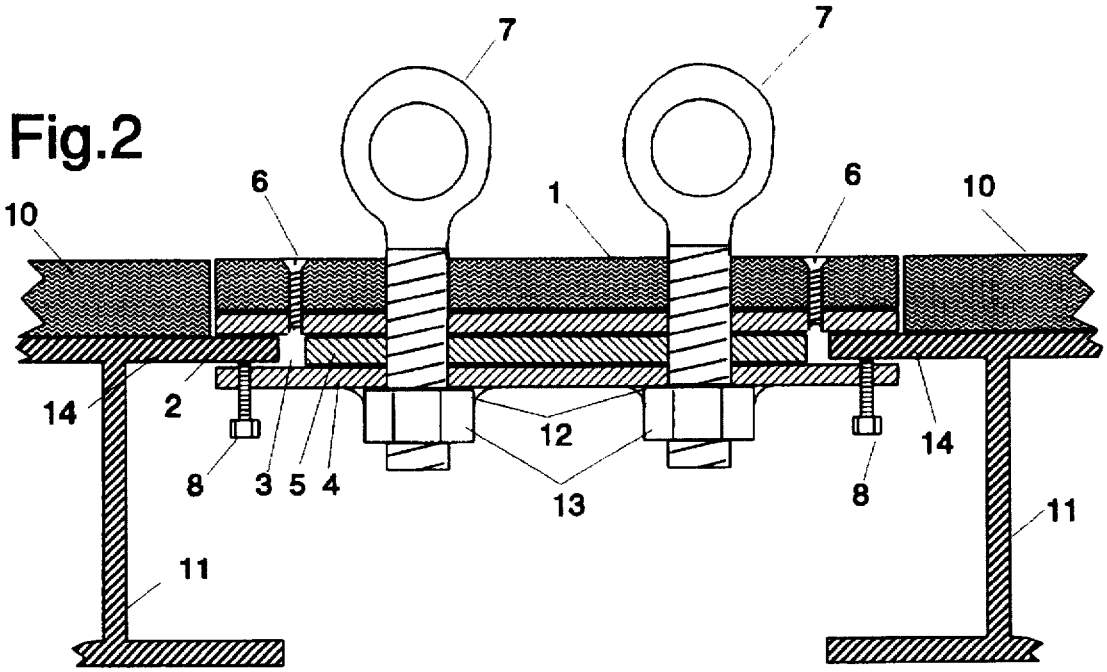
FIG. 2 shows a side cut-away view of the anchor of the invention installed between two I-beams on a deck.

Typically, as shown in FIG. 1, two eye-bolts (7) are preferably provided to provide an anchor point for attachment for safety cables. It is possible within the teachings of the invention, however, to have one eyebolt, or three or more eyebolts, or other shapes of anchor points such as cleats, hooks, or D-rings or similar anchor points with spring-loaded gates. The eye-bolts (7) are inserted into mating holes (9), which extend through all of the layers of the anchor, and screwed down. The eye-bolts (7) are preferably heavy-duty ¾" bolts, which are sufficiently heavy and large to accept the D-ring attachments of safety cables and will support the weight required by the safety regulations. Mating nuts (13) for the eye-bolts (7) are rigidly fastened to the lower plate (4), preferably by welding (12), to form a fastening means for the anchor point, so that the eye-bolts or other anchors inserted into the holes (9) can be screwed tightly and securely into the anchor.

In use, the anchor of the invention is placed between two I-beams as they are assembled to support the deck. The upper flange (14) of the I-beams (11) is inserted into the end gaps (3) between the upper (2) and lower (4) plates of the anchor, and the setscrews (8) are tightened down firmly against the flanges (14). This serves the dual function of rigidly fastening the anchor to the two I-beams, and also adds to the rigidity of the deck structure.

The eye-bolts are screwed into the anchors, and the anchors are used as the floor structure is assembled, and the decking laid.

As the plywood decking is fastened down to the I-beams, the sheets will need to be cut out around the anchors. Preferably, the anchors are spaced along the beams such that they will fall approximately between the ends of the plywood sheets to be used for decking (i.e. at distances divisible by the 4 foot width or 8 foot length of the sheets). Using this technique, the cutouts for the anchors will fall between sheets, making it an easy task to notch the edge of the sheets rather than having to measure and cut a hole in the center of a sheet. The length of the safety cables being used will also factor into the minimum spacing for the anchors, since the length of the cable will define a radius of operations for the workers.

Once the decking is laid, and the reinforcing gridwork placed, the eyebolts are removed from the anchors and the holes are plugged. This can most simply be done with a strip of duct tape, although actual plugs which would fit flush with the upper surface of the face layer could be provided if desired. Then, concrete is poured over the plywood decking, leaving the anchors in place.

When the concrete of the floor has cured, the supporting structure is disassembled, and the anchors, beams, columns and plywood can be reused in another floor.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A safety cable deck anchor for a deck of the kind comprising a plurality of parallel I-beams having upper flanges with a thickness and a spacing between the upper flanges on two adjacent I-beams, and a plywood flooring having a thickness, the anchor comprising:

a) an upper plate and a lower plate, each having a thickness, and a length slightly longer than the spacing between the upper flanges of the I-beams of the deck;

b) a rigid spacer layer located between the upper plate and the lower plate, having a thickness slightly greater than the thickness of the upper flange of the I-beams and a length slightly less than the spacing between the upper flanges of the I-beams of the deck, the spacer layer being rigidly fastened into position centered between the upper plate and lower plate such that a gap is formed at each end of the spacer layer between the upper plate and the lower plate;

c) the upper plate, spacer layer and lower plate having at least one hole aligned in each for passage therethrough of an anchor point means for attaching a safety cable;

d) at least one fastening means for fastening an anchor point means, attached to the lower plate and aligned with the hole through the upper plate, spacer layer and lower plate, such that an anchor point means inserted through the hole can be firmly fastened down to the anchor by the fastening means; and e) anchor point means for securing a safety cable, fastened to the fastening means for fastening an anchor point means, such that a safety cable secured to the anchor point means is firmly fixed to the I-beams of the deck.

2. The safety cable deck anchor of claim 1, further comprising a face layer attached to the upper plate, having a length substantially equal to that of the upper plate, and a thickness chosen such that the combined thickness of the upper plate and the face layer is substantially equal to the thickness of the plywood flooring, the face layer having at least one hole aligned with the hole in the upper plate, spacer layer and lower plate, for passage therethrough of the anchor point means for attaching a safety cable.

3. The safety cable deck anchor of claim 1, in which the anchor point means is an eyebolt.

4. The safety cable deck anchor of claim 1, in which the fastening means comprises at least one nut welded to the lower surface of the lower plate, and the anchor point means has screw threads on one end thereof, the nut being threaded to mate with the screw threads on the anchor point means.

5. The safety cable deck anchor of claim 1, further comprising setscrew means threaded into threaded holes located in the ends of the lower plate, such that when the setscrew means are threaded into the hole, the setscrew extends into the gap between the lower plate and the upper plate, such that an I-beam flange inserted into the gap is firmly held into place by the setscrew means.

6. The safety cable deck anchor of claim 1 in which the upper plate, lower plate and spacer layers are welded together.

* * * * *